US005139036A

United States Patent [19]

Pickard

[11] Patent Number: 5,139,036

[45] Date of Patent: Aug. 18, 1992

[54] FINGERNAIL POLISH REMOVAL APPARATUS

[76] Inventor: William L. Pickard, P.O. Box 409, Southern Pines, N.C. 28388

[21] Appl. No.: 779,072

[22] Filed: Oct. 18, 1991

[51] Int. Cl.[5] ..... A45D 29/18

[52] U.S. Cl. ..... 132/73.5; 132/75; 132/75.6; 132/76.4

[58] Field of Search ..... 132/286, 287, 288, 313, 132/314, 317, 73.5, 74.5, 75, 75.6, 76.4, 76.5; 206/581, 823

[56] References Cited

U.S. PATENT DOCUMENTS

| | | | |
|---|---|---|---|
| 1,847,572 | 3/1932 | Rich | 132/287 |
| 2,219,597 | 10/1940 | lutz | 206/581 |
| 3,126,022 | 3/1964 | Thompson | 132/288 |
| 3,134,383 | 5/1964 | Thompson | 132/288 |
| 3,478,763 | 11/1969 | Weinstein | 132/75 |
| 3,665,867 | 5/1972 | Carlson et al. | 132/73.5 |
| 3,774,993 | 11/1973 | Senee | 132/73.5 |
| 4,286,609 | 9/1981 | Miller | 132/75 |
| 4,296,766 | 10/1981 | Benis | 132/73.5 |
| 4,359,060 | 11/1982 | Walker | 132/75 |
| 4,533,051 | 8/1985 | Fleming | 206/581 |

*Primary Examiner*—John J. Wilson
*Assistant Examiner*—Frank A. LaViola
*Attorney, Agent, or Firm*—Hugh E. Smith & Assoc.

[57] ABSTRACT

A fingernail polish trough is provided filled with a fingernail polish removing fluid positioned forwardly of a series of adjacent parallel "V" shaped grooves positioned rearwardly and above the trough. The trough and grooves define an upper housing arranged for securement to an underlying container for storage. A modification of the invention includes the underlying container formed with an intermediate container housing mounting the upper housing thereon directing electrical current to an illumination lens and manually manipulatable magnification lens to enhance viewing in operation of the cleaning and manicuring of fingernails.

1 Claim, 4 Drawing Sheets

FINGERNAIL POLISH REMOVAL APPARATUS

BACKGROUND OF THE INVENTION

1. Field of the Invention

The field of invention relates to manicure apparatus, and more particularly pertains to a new and improved fingernail polish removal apparatus wherein the same is arranged to provide for a convenient organization to remove fingernail polish relative to an individual.

2. Description of the Prior Art

Various prior art structure has been provided to the directing of removal of fingernail polish relative to an individual. The prior art has addressed this issue as exemplified in U.S. Pat. No. 4,510,954 to Miller wherein in an apparatus utilizes a rotary drum formed with brushes to enhance removal of fingernail polish relative to the fingernail.

U.S. Pat. No. 4,819,672 to Walker sets forth a nail polish removal container wherein a housing includes various projections within a well to enhance removal of fingernail polish relative to a fingernail.

As such, it may be appreciated that there continues to be a need for a new and improved fingernail polish removal apparatus as set forth by the instant invention which addresses both the problems of ease of use as well as effectiveness in construction in providing an organization to accomodate the removal of fingernail polish relative to an individual.

SUMMARY OF THE INVENTION

In view of the foregoing disadvantages inherent in the known types of fingernail polish removal apparatus now present in the prior art, the present invention provides a fingernail polish removal apparatus wherein the same is arranged for the positioning of an individual's hand relative to a fingernail polish removal fluid containing trough to ease removal of fingernail polish relative to an individual. As such, the general purpose of the present invention, which will be described subsequently in greater detail, is to provide a new and improved fingernail polish removal apparatus which has all the advantages of the prior art fingernail polish removal apparatus and none of the disadvantages.

To attain this, the present invention provides a fingernail polish trough filled with a fingernail polish removing fluid positioned forwardly of a series of adjacent "V" shaped grooves positioned rearwardly and above the trough. The trough and grooves define an upper housing arranged for securement to an underlying container for storage. A modification of the invention includes the underlying container formed with an intermediate container housing mounting the upper housing thereon directing electrical current to an illuminationn lens and manually manipulatable magnification lens to enhance viewing in operation of the cleaning and manicuring of fingernails.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject mattter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fingernail polish removal apparatus which has all the advantages of the prior art fingernail polish removal apparatus and none of the disadvantages.

It is another object of the present invention to provide a new and improved fingernail polish removal apparatus which may be easily and efficiently manufactured and marketed.

It is further object of the present invention to provide a new and improved fingernail polish removal apparatus which is of a durable and reliable construction.

An even further object of the present invention is to provide a new and improved fingernail polish removal apparatus which is susceptible of a low cost of manufacture with regard to both materials and labor, and which accordingly is then susceptible of low prices of sale to the consuming public, thereby making such fingernail polish removal apparatus economically available to the buying public.

Still yet another object of the present invention is to provide a new and improved fingernail polish removal apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is an isometric illustration of a modification of the invention.

DESCRIPTION OF THE PREFERRED EMBODIMENT

Figure 1:
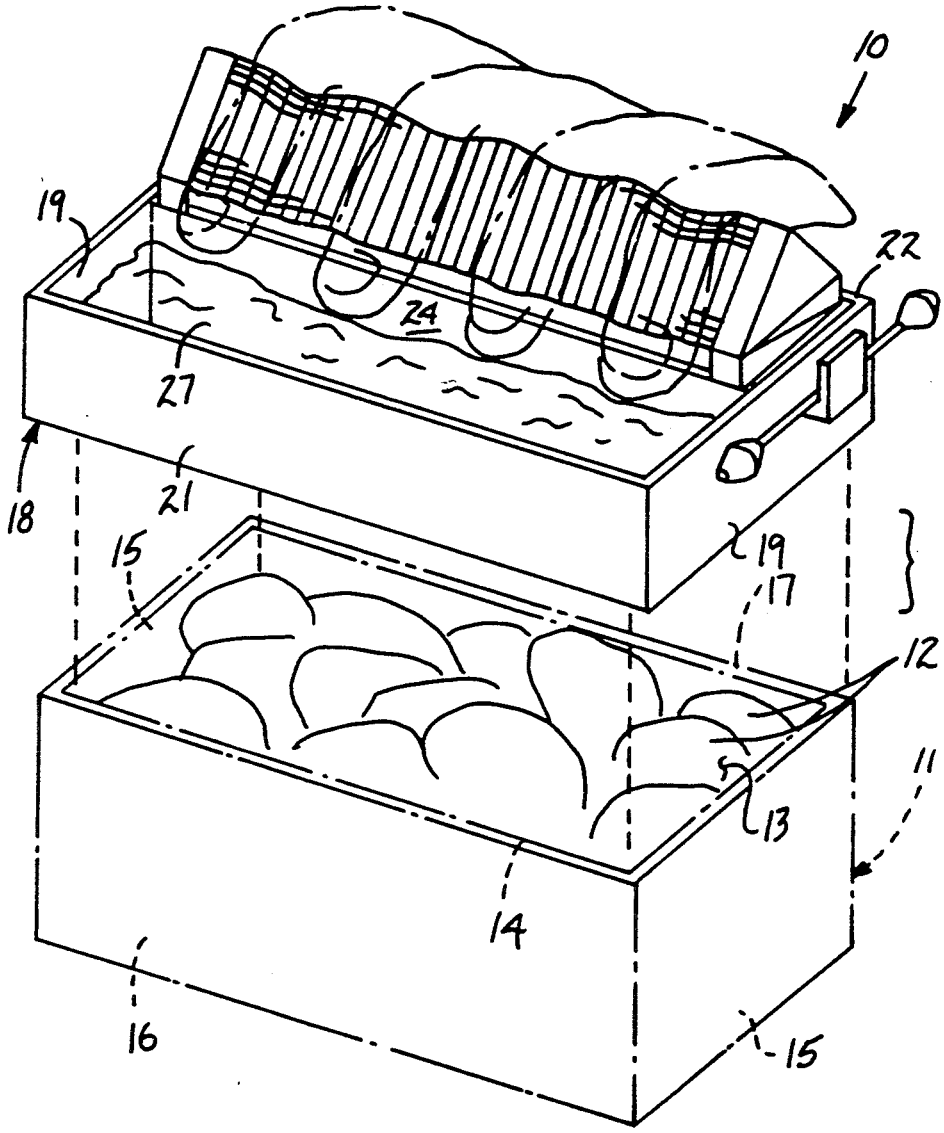
FIG. 1 is an isometric illustration of the instant invention.
Figure 2:
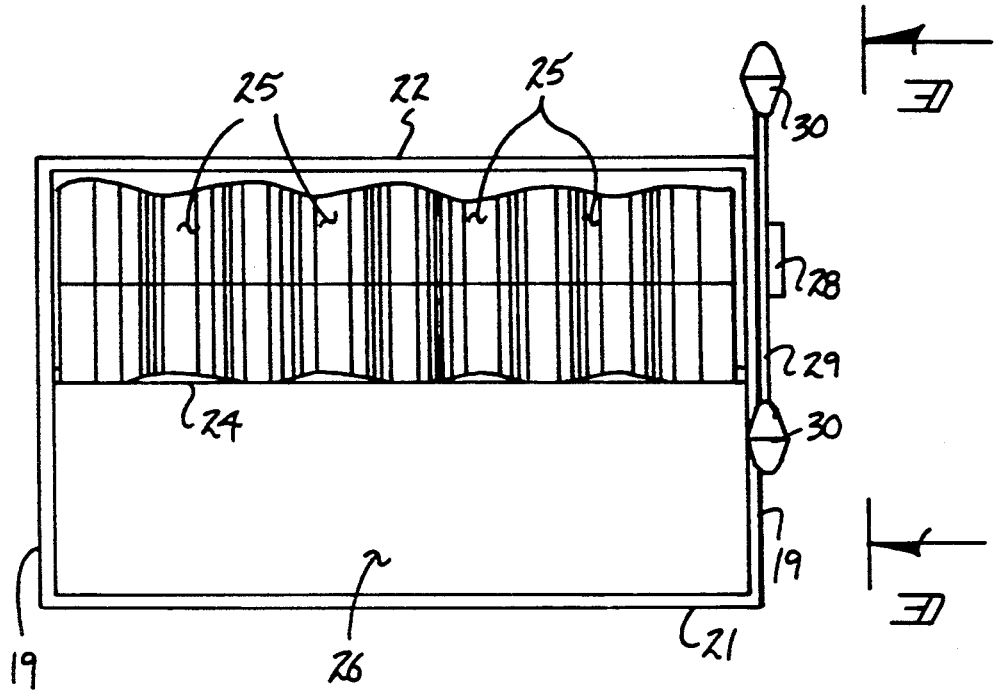
FIG. 2 is an orthographic top view of the instant invention.
Figure 3:
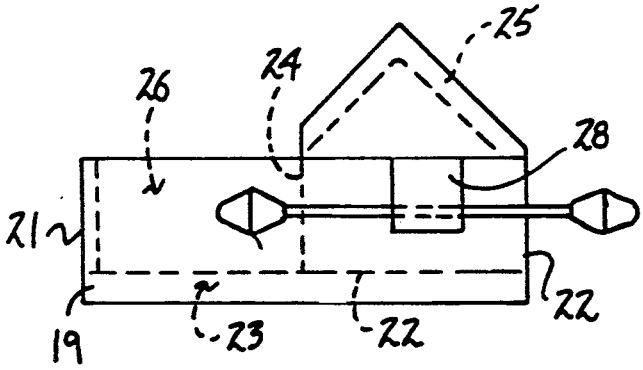
FIG. 3 is an orthographic side view of the instant invention.
Figure 3:
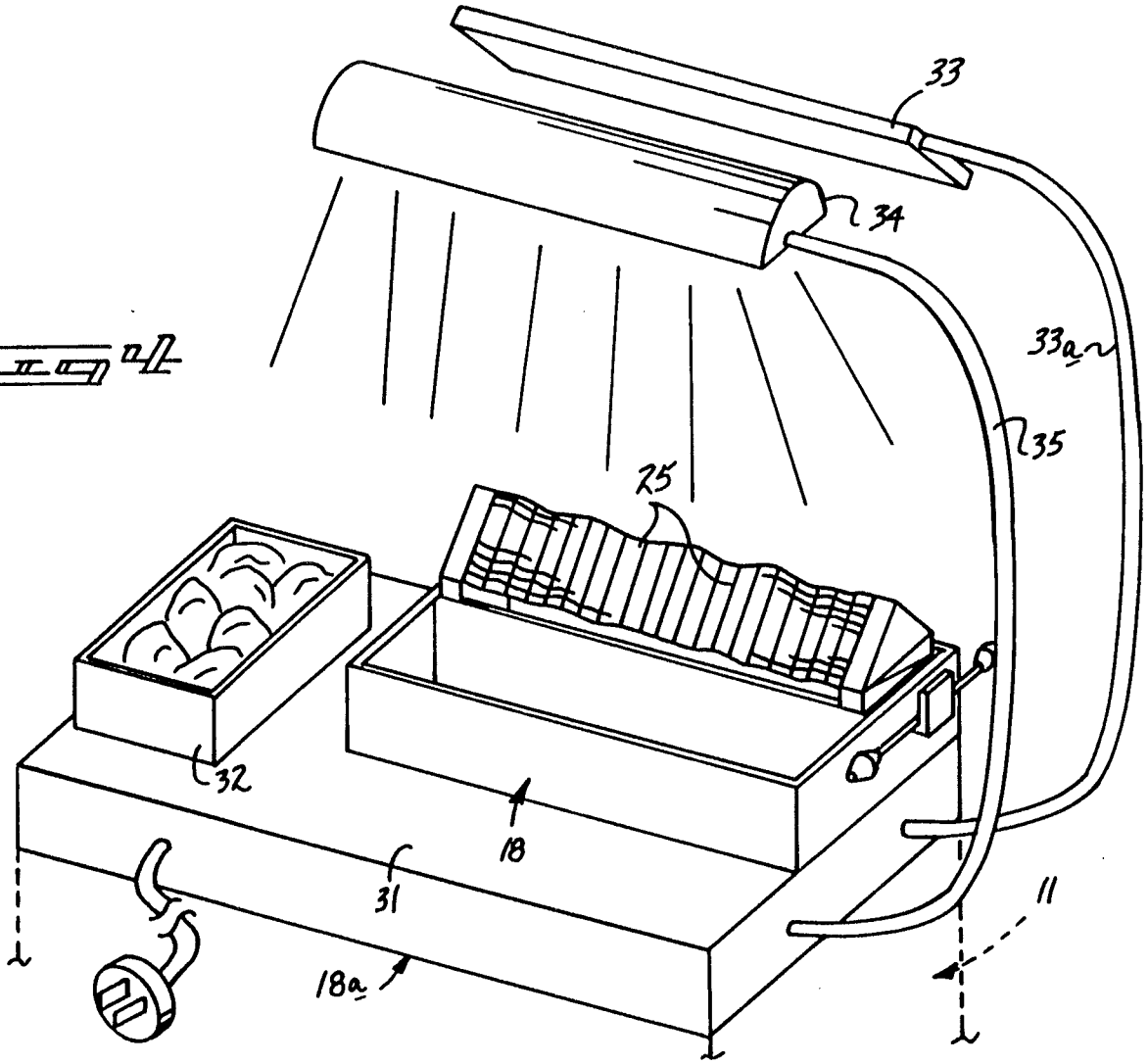

With reference now to the drawings, and in particular to FIGS. 1 to 5 thereof, a new and improved fingernail polish removal apparatus embodying the principles and concepts of the present invention and generally designated by the reference numeral 10 will be described.

More specifically, the fingernail polish removal apparatus 10 of the instant invention essentially comprises a storage container 11 defined by a storage container cavity 12, including a quantity of cotton balls 13 therewithin for use by the organization. A storage container upper continuous edge 14 is defined by spaced parallel side walls 15 and a storage container front wall 16 spaced from a front container rear wall 17. The upper continuous edge 14 is complementarily received within an upper housing 18, with upper housing side walls 19, upper housing front wall 20, and an upper housing rear wall 21. An upper housing floor 22 defines an upper housing lower cavity 23 to complementarily receive the storage container 11 and the upper continuous edge 14 therewithin to engage with a bottom surface of the floor 22. A medial wall 24 arranged parallel to the front and rear walls 21 and 22 are coextensive therewith. A plurality and more specifically four "V" shaped grooves 25 originate from the rear wall 22 and terminate at the medial wall 24 as the grooves 25 are in a parrallel contiguous relationship relative to one another and project above the medial wall 24 and the rear wall 22, as well as the side walls 19 as illustrated, where an individual positions that individual's fingers minus the thumb into the grooves 25 permitting projection of the fingernails into a fluid trough 26 defined between the medial wall 24, the front wall 21, and the side walls 19 spaced above the floor 22 to contain a fingernail polish solvent 27 therewithin. A clip member 28 is mounted to one of the side walls to define a slot to receive a cotton swab shaft 29, including cotton swab portions 30 at each distal end of the shaft.

FIG.4 illustrates the use of an intermediate housing **18*a* that includes an intermediate housing top wall 31, with the upper housing 18 mounted thereon. A cotton ball container member 32 is positioned in a spaced relationship relative to the upper housing 18 and fixedly mounted to the top wall 31 as illustrated. A magnification lens 33 is provided mounted at an upper distal end of a malleable goose neck support to permit manual manipulation of the lens relative to the grooves 25 in cooperation with an illumination housing 34 containing an illumination member therewithin that is mounted to an upper distal end of a manually manipulatable goose neck housing support 35, as the illumination housing 34 is in electrical communication with electrical power supply 36 directed exteriorly of the intermediate housing 18*a* . As illustrated, the lower distal ends of the goose neck supports 33*a* and 35 are directed into the intermediate housing 13*a*** .

Figure 5:
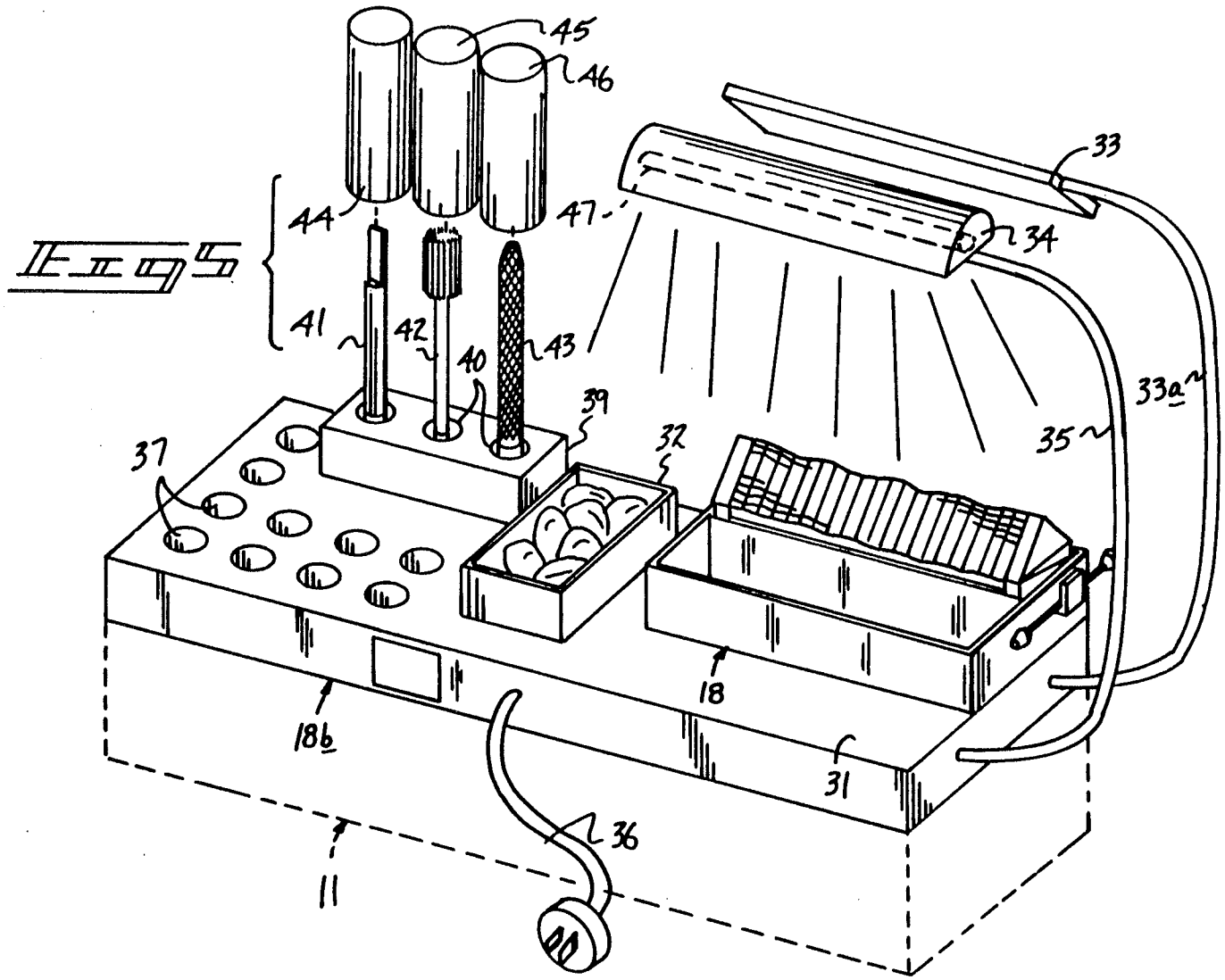
FIG. 5 is an isometric illustration of a further modification of the invention.

The FIG. 5 illustrates a modified intermediate housing **18*b* to further include for convenience in providing a complete assemblage in a manicuring procedure of a matrix of cylindrical nail polish tube receiving wells 37 directed orthogonally into the top wall 31. Further, a support boss 38 is provided to include a plurality of manicuring tools to include a respective first tool cuticle cutter 41, a second tool brush member 42, and a third tool file member 43. Each of the tools 41, 42, and 43 are contained within a support boss cylindrical well 40. A respective first, second and third tube 44, 45, and 46 respectively are slidably mounted above the various tools defined by the respective first, second, and third tools 41, 42, and 43. It should be further noted that the storage container 11 is accordingly complementarily received within the intermediate and modified intermediate housing 18*a* and 18*b* of the FIGS. 4 and 5 respectively to contain the cotton balls, in a manner as illustrated in the FIG. 1 It should be understood of course, that an illumination bulb 47, as illustrated in phantom in the FIG. 5, is provided in electrical communication between the electrical power suply transmission line 36 and the illumination bulb 47 through the goose neck housing support 35**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A fingernail polish apparatus, comprising, an upper housing, the upper housing including spaced parallel side walls, and a front wall spaced from and parallel a rear wall, and the upper housing including a floor orthogonally mounted to the side walls, the front wall, and the rear wall adjacent a lower distal end of the upper housing, and the housing further including a medial wall positioned medially of and parallel the front wall and rear wall coextensive therewith extending between the side walls, and a plurality of V-shaped grooves arranged in a parallel contiguous relationship extending between and above the medial wall, the rear wall, and the side walls, and a fluid trough defined between the medial wall, the front wall, the side walls, and the floor, and a predetermined quantity of fingernail polish solvent contained within the fluid trough, and including a clip member mounted to at least one of said side walls, wherein the clip member defines a slot between the clip member and the at least one side wall, and at least one cotton swab shaft contained within the slot, the cotton swab shaft including a swab cotton tuft at each end of the shaft, and an intermediate housing, the intermediate housing including a top wall and defining an intermediate housing cavity within the intermediate housing below the top wall, and the upper housing fixedly mounted to a top surface of the top wall, and a storage container, the storage container including a predetermined quantity of cotton balls contained therewithin, and the storage container defining an upper continuous edge, the upper continuous edge complementarily received within the intermediate housing cavity, and the intermediate housing top wall includes a cotton ball container member positioned adjacent to and in a spaced relationship relative to the upper housing fixedly mounted to the intermediate housing top wall, including a predetermined quantity of cotton balls contained therewithin, and further including a matrix of cylindrical parallel wells directed into the intermediate housing orthogonally relative to the top wall for reception of fingernail polish tubes to be contained therewithin, and a support boss positioned adjacent the wells, the support boss including a plurality of support boss cylindrical wells directed into the support boss, wherein the cylindrical support boss wells includes a first cylindrical boss well, a second cylindrical boss well, and a third cylindrical boss well, the first cylindrical boss well including a first tool cuticle cutter, the second cylindrical boss well including a second tool brush member, and the third cylindrical boss well including a third tool file member, and a first tube arranged for receiving the first tool cuticle cutter therewithin for mounting upon the support boss, the second tube for receiving the second tool brush member mounting upon the support tool file member for mounting on the support boss when containing the third tool file member therewithin, and the intermediate housing incudes a first manually manipulatable goose neck support mounted to the intermediate housing at a lower distal end of the neck support and an upper distal end of the goose neck support includes a magnification lens positioned above the V-shaped grooves, and a further manually manipulatable goose neck support includes a further goose neck support lower distal end mounted to the intermediate housing, and an upper further goose neck support upper distal end includes an illumination housing mounted thereto, and an electrical transmission line directed into the intermediate housing for providing electrical current to the illumination housing for effecting illumination of a bulb member contained therewithin.

* * * * *